US006066076A

United States Patent [19]

Wang et al.

[11] Patent Number: 6,066,076

[45] Date of Patent: May 23, 2000

[54] STEPPING EXERCISER

[76] Inventors: Mei-San Wang, No. 27 3, Lane 31, Sec. 1. San-Min Rd., Pan-Chiao City, Taiwan; Lien-Chuan Yang, 11F-1, No. 149, Sec. 3. Roosevelt Rd., Taipei, Taiwan

[21] Appl. No.: 09/154,211

[22] Filed: Sep. 16, 1998

[51] Int. Cl.[7] ..... A63B 22/04

[52] U.S. Cl. ..... 482/52; 482/51

[58] Field of Search ..... 482/51–53, 57, 482/70, 146, 147

[56] References Cited

U.S. PATENT DOCUMENTS

| | | | |
|---|---|---|---|
| 4,391,441 | 7/1983 | Simjian | 482/147 |
| 5,545,111 | 8/1996 | Wang et al. | 482/147 |
| 5,628,709 | 5/1997 | Chen | 482/53 |
| 5,645,512 | 7/1997 | Yu | 482/53 |
| 5,749,809 | 5/1998 | Lin | 482/52 |
| 5,908,373 | 6/1999 | Pitre | 482/57 |

*Primary Examiner*—Stephen R. Crow
*Attorney, Agent, or Firm*—Dougherty & Troxell

[57] ABSTRACT

A stepping exerciser including a base frame, an upper support, a stepping device, a front stem, a rear seat stem and a damper. When two pedal levers of the stepping device are alternately stepped up and down, the pushing arms under the pivot tubes of the pedal levers drive the linkages to alternately swing back and forth. At this time, the driving rods under two sides of the rotary discs are driven to rotate the rotary disc. Responsively, the handle bar connected with upper end of the front stem connected with the rotary disc are alternately swung left and right. Accordingly, the feet of a user alternately step on the pedals to a large extent and simultaneously, the waist and hands of the user correspondingly act to achieve an exercising effect.

3 Claims, 3 Drawing Sheets

STEPPING EXERCISER

BACKGROUND OF THE INVENTION

The present invention relates to a stepping exerciser by which the feet of a user can alternately step on two pedals to a large extent and simultaneously exercise the waist and both hands of the user.

A conventional stepping exerciser enables a user to alternately step down the pedals so as to exercise the feet of the user. However, such stepping exerciser can provide a stepping exercise to a small extent. In addition, the waist of the user cannot be twisted and exercised. Moreover, such stepping exerciser has large volume which will occupy much room when stored or transferred.

SUMMARY OF THE INVENTION

It is a primary object of the present invention to provide a stepping exerciser by which the feet of a user can alternately step on two pedals to a large extent and simultaneously the waist alternately twisted left and right and both hands of the user are moved back and forth to a large extent.

It is a further object of the present invention to provide a stepping exerciser in which the handle bar, front stem, rear seat stem and the front beam can be disassembled so as to save space and facilitate the storage and transferring.

It is still a farther object of the present invention to provide a stepping exerciser in which the heights of the handle stem and the paddle can be adjusted to meet the requirements of different users.

According to the above objects, the stepping exerciser of the present invention includes a base frame, an upper support, a stepping device, a front stem, a rear seat stem and a damper. The base frame includes a main beam and a front beam. A rotary disc is disposed at front end of the base frame. The rotary disc is disposed with a locating column. The upper support is disposed on the main beam of the base frame for pivotally connecting with the stepping device. The stepping device includes two pedals connected with the rotary disc by a linkage mechanism, whereby by means of stepping on the pedals up and down, the linkage mechanism is driven to drive the rotary disc to rotate. The front stem is pivotally connected with the locating column of the rotary disc. A top end of the front stem is disposed with a handle stem. The rear seat stem is disposed at a rear end of the base frame. A top end of the rear seat stem is disposed with a paddle. By means of stepping on the pedals, the linkage mechanism drives the rotary disc to rotate, whereby the front stem and handle stem are swung so as to exercise the feet, waist and hands of a user to a great extent.

The present invention can be best understood through the following description and accompanying drawings, wherein:

DETAILED DESCRIPTION OF THE PREFERRED EMBODIMENT

Figure 1:
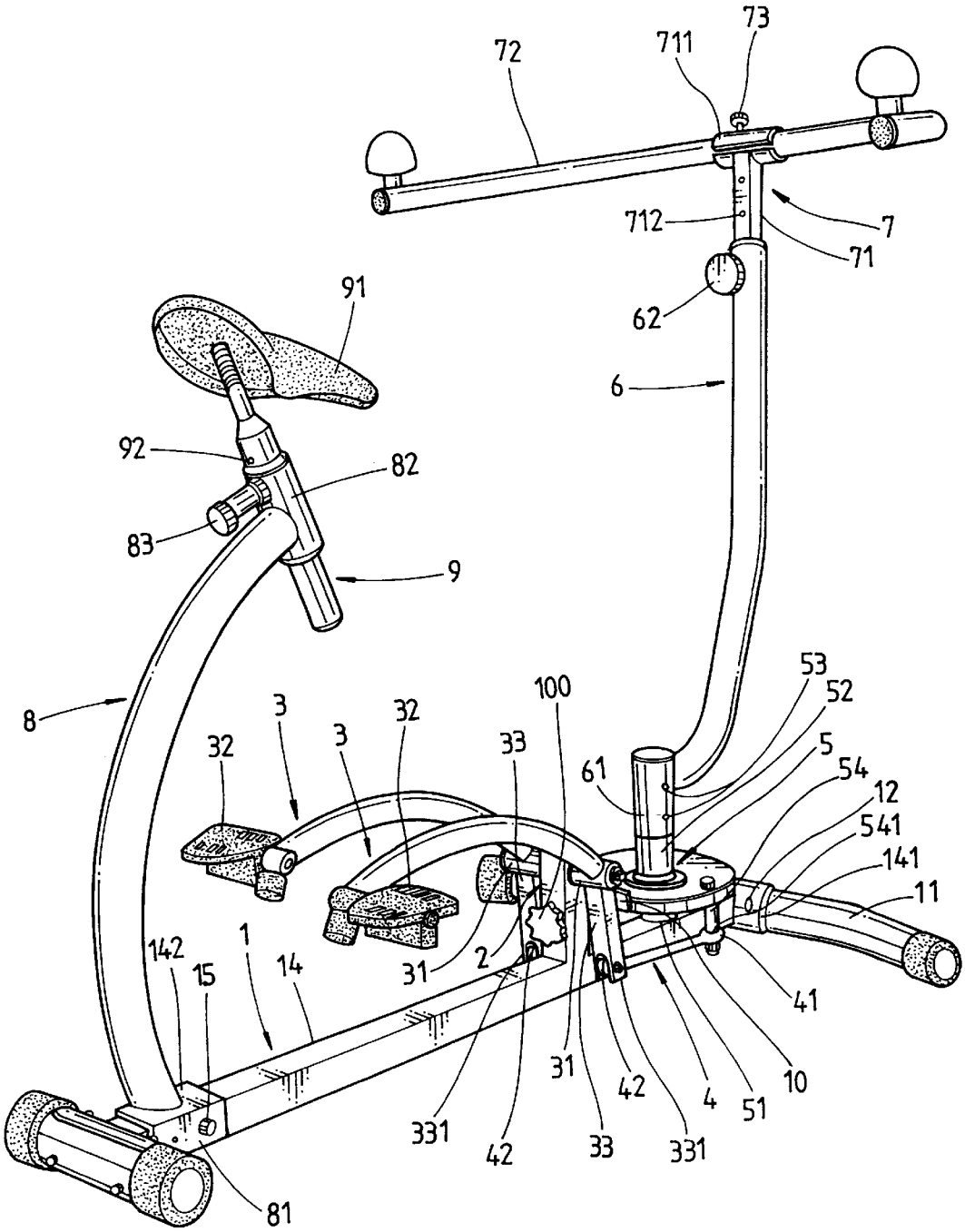
FIG. 1 is a perspective assembled view of the present invention.
Figure 2:
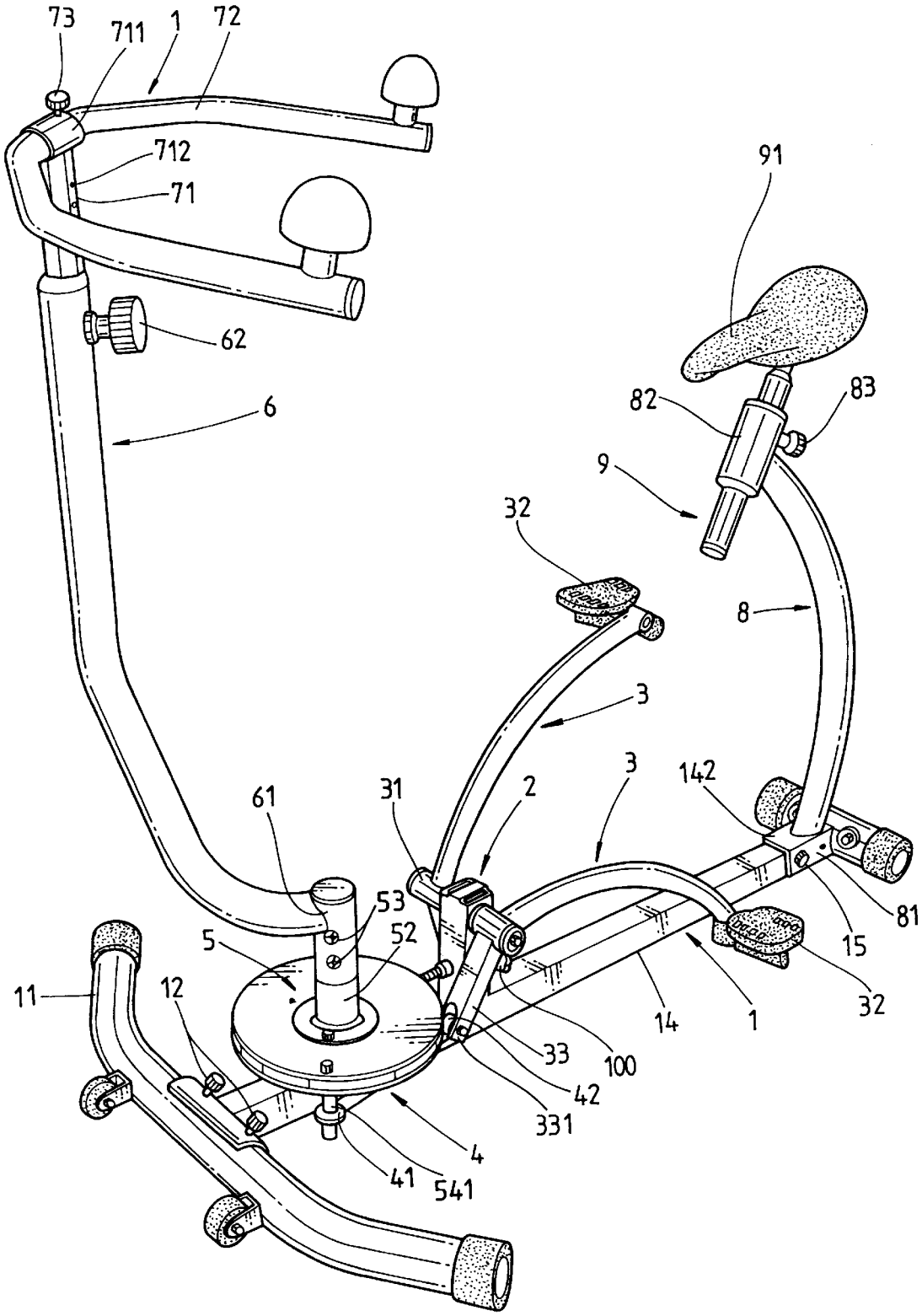
FIG. 2 is a perspective assembled view of the present invention in a stepping state.
Figure 3:
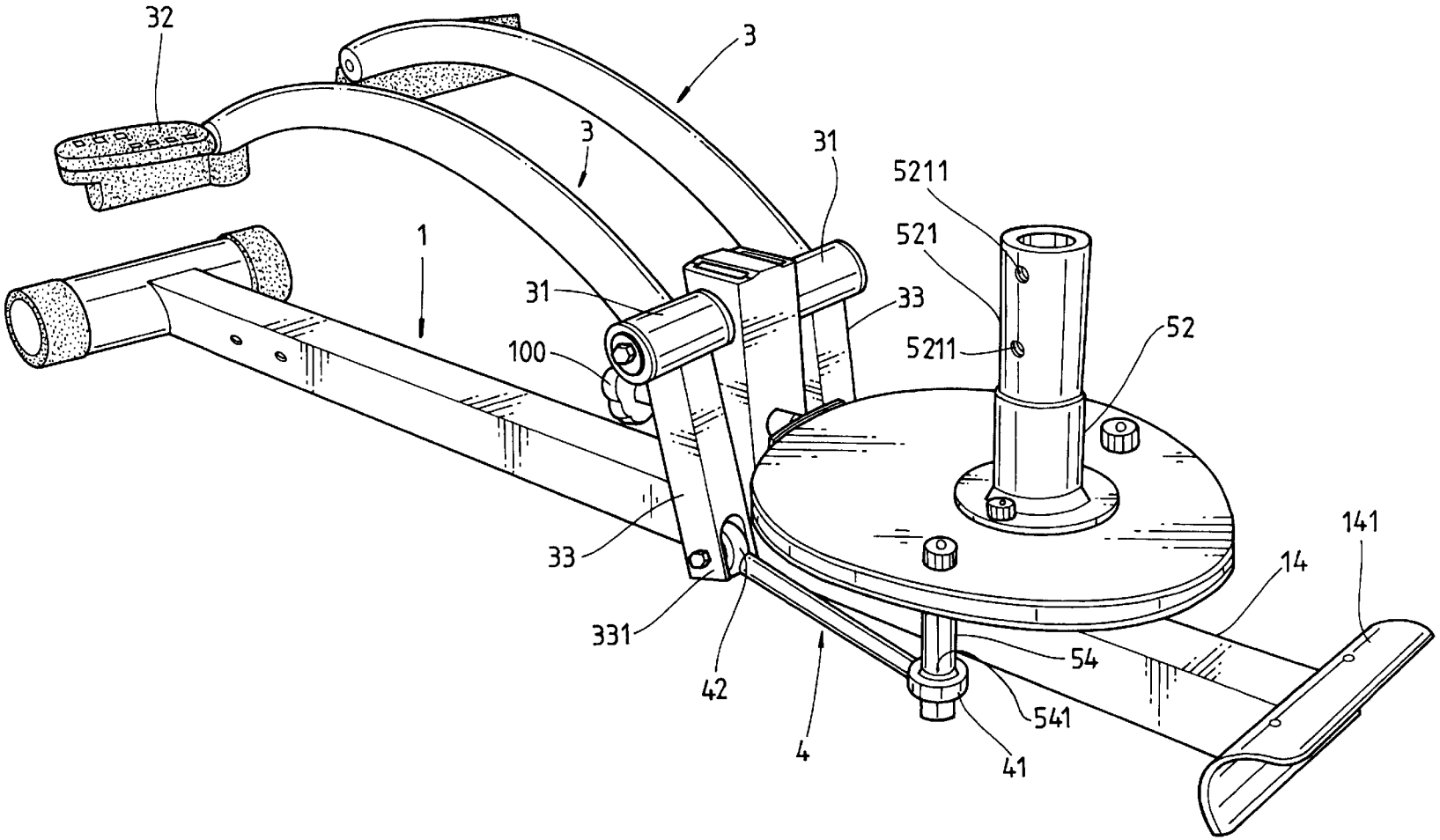
FIG. 3 is a perspective enlarged view of a part of the present invention.

Please refer to FIGS. 1 to 3. The present invention includes a base frame 1 composed of a front beam 11 and a main beam 14 having a locating plate 141 at front end. The front beam 11 is locked with the locating plate 141 by adjustment screws 12. A rotary disc 5 is rotatably mounted on front side of the main beam 14. An upper support 2 upward extending by a certain length is fixedly disposed on the main beam 14 and spaced from the rotary disc 5 by a certain distance. A rear end 142 of the main beam 14 is locked with a lower end of a rear stem 8 by adjustment screws 15. A transverse shaft (not shown) is passed through the upper section of the upper support 2 with two ends respectively extending out of two sides thereof for pivotally connecting with the pivot tubes 31 disposed at lower sections of two pedal levers 3. An upper end of each pedal lever 3 is fixedly disposed with a pedal 32. A pushing arm 33 is connected under each pivot tube 31. The lower section of the pushing arm 33 is formed with a pivot wall 331 pivotally connected with a rear end of a linkage 4. The front end of the linkage 4 is equipped with a universal joint 41 having a vertical opening. The joint 41 is pivotally connected with a lower end of a driving rod 54 disposed under each side of the rotary disc 5 (referring to FIG. 3). The rear end of the linkage 4 is equipped with a universal joint 42 having a horizontal opening. The joint 42 is pivotally connected with the pivot wall 331 of the pushing arm 33. The rotary disc 5 has a pivot shaft 51 on lower side for pivotally connecting with an upper side of the main beam 14. The upper side of the rotary disc 5 is disposed with a stepped locating column 52. A fitting tube 61 of lower end of a front stem 6 is fitted with a small diameter section of the locating column 52 and locked therewith by screws 53. A lower support 71 of a handle stem 7 is extended into and locked with an upper tube body of the front stem 6 by adjustment screws 62. A middle section of a handle bar 72 is locked with a locating collar 711 at upper end of the lower support 71 of the handle stem 7 by adjustment screws 73. The lower support 71 is formed with several thread holes 712 for selectively locking with upper end of the front stem 6 by adjustment screws 62. The locating plate 81 of the lower end of the rear seat stem 8 is locked with the rear end of the main beam 14 by adjustment screws 15. A sleeve 82 is disposed at upper end of the rear seat stem 8 for selectively locking with one of locating holes 92 of a seat pillar by adjustment screws 83. A saddle 91 is fixedly mounted at upper end of the seat pillar 9.

According to the above arrangement, when the pedal levers 3 are alternately stepped up and down, the pushing arms 33 under the pivot tubes 31 of the pedal levers 3 drive the linkages 4 to alternately swing back and forth. At this time, the driving rods 54 under two sides of the rotary discs 5 are driven to rotate the rotary disc 5. Responsively, the handle bar 7 connected with upper end of the front stem 6 are alternately swung left and right. Accordingly, the feet of a user alternately step on the pedals to a large extent and simultaneously, the waist and hands of the user correspondingly act to twist the waist. When it is desired to adjust the height of the handle stem 7, the adjustment screws 62 are untightened and another thread hole 712 of the lower support 71 of the handle stem 7 is selected to further lock with the adjustment screws 62. When it is desired to adjust the height of the saddle 91, the adjustment screws 83 are untightened and another locating hole 92 is selected to further lock the seat pillar 9 with the rear seat stem 8. When it is desired to store or transfer the exerciser, the adjustment screws 62 locking the handle stem 7 with the front stem 6 are untightened, the screws 52 locking the front stem 6 with the rotary disc 5 are tightened, the adjustment screws 15 locking the rear seat stem 8 with the base frame 1 and the adjustment screws 12 locking the front beam 11 with the main beam 14 are untightened. Then the handle stem 7, front stem 6, rear seat stem 8 and the front beam 11 are removed so as to save space and facilitate the storage and package.

In addition, the upper support is disposed with a damper 10 abutting against the rim of the rotary disc for giving a resistance to the rotary disc 5. By means of rotating the adjustment screw 100, the value of the resistance can be adjusted.

In conclusion, the stepping exerciser of the present invention enables a user to alternately step on the pedals to a great extent so as to exercise his/her feet. Also, in the stepping action, the waist of the user is twisted and exercised. Furthermore, the heights of the handle stem and the paddle can be adjusted to meet the requirements of different users. The handle bar, front stem, rear seat stem and the front beam can be disassembled so as to save space and facilitate the storage and transferring.

It should be noted that the above description and accompanying drawings are only used to illustrate one embodiment of the present invention, not intended to limit the scope thereof Any modification of the embodiment should fall within the scope of the present invention.

What is claimed is:

1. A stepping exerciser comprising a base frame, an upper support, a stepping device, a front stem, a rear seat stem and a damper, wherein:

the base frame includes a main beam and a front beam, a rotary disc being disposed at a front end of the base frame, the rotary disc having a locating column, the base frame connected to the front stem and the rear seat stem;

the upper support is located on, and extends upwardly from the main beam of the base frame;

the stepping device is pivotally connected to the upper support and includes two pedals connected with the rotary disc by a linkage mechanism, whereby by means of moving the pedals up and down, the linkage mechanism rotates the rotary disc;

said linkage mechanism comprises a link connected with each of the two pedals, a first end of each link having a universal joint pivotally connected with a driving rod connected to the rotary disc so as to pull the rotary disc left and right;

the front stem is connected to the locating column of the rotary disc so as to move therewith, a top end of the front stem having a handle stem;

the rear seat stem is connected to a rear end of the base frame, a top end of the rear seat stem having a saddle; and the damper has an adjustment screw and is located on the upper support and abuts against a rim of the rotary disc, whereby by means of adjusting the screw, the resistance against the rotary disc is controlled; such that by moving the pedals up and down, the linkage mechanism rotates the rotary disc, whereby the front stem and handle stem are swung so as to exercise the feet, waist and hands of a user.

2. The stepping exerciser as claimed in claim 1, wherein the main beam and the front beam of the base frame are detachably connected with each other, and a rear end of the main beam is detachably connected with the rear seat stem.

3. The stepping exerciser as claimed in claim 1, further comprising: a pivot tube extending from a lower side of each pedal, the pivot tube being pivotally connected with the upper support; and a pushing arm extending from the pivot tube and connected with the rotary disc through the linkage mechanism.

* * * * *